US011772381B2

(12) United States Patent
Kusunoki

(10) Patent No.: US 11,772,381 B2
(45) Date of Patent: Oct. 3, 2023

(54) HEAD CAP AND INKJET RECORDING APPARATUS

(71) Applicant: KYOCERA Document Solutions Inc., Osaka (JP)

(72) Inventor: Yoshiya Kusunoki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/698,803

(22) Filed: Mar. 18, 2022

(65) Prior Publication Data

US 2022/0305789 A1 Sep. 29, 2022

(30) Foreign Application Priority Data

Mar. 29, 2021 (JP) ..... 2021-055829

(51) Int. Cl.
*B41J 2/165* (2006.01)

(52) U.S. Cl.
CPC ..... *B41J 2/16552* (2013.01); *B41J 2/16505* (2013.01); *B41J 2/16535* (2013.01); *B41J 2/16538* (2013.01)

(58) Field of Classification Search
CPC ..... B41J 2/16552; B41J 2/16505; B41J 2/16535; B41J 2/16538
See application file for complete search history.

(56) References Cited

U.S. PATENT DOCUMENTS 6,481,826 B1 * 11/2002 Hara ..... B41J 2/16508 347/29
7,753,474 B2 * 7/2010 Hiruma ..... B41J 2/16511 347/29

FOREIGN PATENT DOCUMENTS

JP 2013-176898 A 9/2013

* cited by examiner

*Primary Examiner* — Geoffrey S Mruk
(74) *Attorney, Agent, or Firm* — Studebaker & Brackett PC

(57) ABSTRACT

A head cap covers an inkjet type recording head. The head cap includes a cap housing and a cap cover. The cap housing has a liquid storage space opened upward. The cap cover is provided along an open end of the cap housing. The cap cover has an opening through which the recording head enters and leaves.

10 Claims, 7 Drawing Sheets

HEAD CAP AND INKJET RECORDING APPARATUS

INCORPORATION BY REFERENCE

This application is based on and claims the benefit of priority from Japanese patent application No. 2021-055829 filed on Mar. 29, 2021, which is incorporated by reference in its entirety.

BACKGROUND

The present disclosure relates to a head cap and an inkjet recording apparatus.

In an inkjet recording medium, in order to eliminate clogging of a recording head due to drying of ink, a purge operation in which the ink is purged from the recording head and a wiping operation in which a nozzle surface is cleaned by a wiping blade are performed. Further, as an inkjet recording apparatus, there is known an apparatus in which a nozzle surface of a recording head is closed with a head cap. The head cap is filled with a cleaning liquid, and by immersing the nozzle surface of the recording head in the cleaning liquid, the adhering of the ink on the nozzle surface and the nozzle hole is suppressed.

In the above-described inkjet recording apparatus, the nozzle surface is moistened by the cleaning liquid, thereby suppressing the aggregation of the ink on the nozzle surface and in the nozzle hole. However, it is difficult to disperse the aggregates of the ink solidified inside the recording head or the like. Further, when the cleaning liquid is shaken, the cleaning liquid tends to be spilled from the head cap.

SUMMARY

In accordance with an aspect of the present disclosure, a head cap covers an inkjet type recording head. The head cap includes a cap housing and a cap cover. The cap housing has a liquid storage space opened upward. The cap cover is provided along an open end of the cap housing. The cap cover has an opening through which the recording head enters and leaves.

In accordance with an aspect of the present disclosure, an inkjet recording apparatus includes the head cap and a wiping blade wiping a nozzle surface of the recording head. A capping operation for covering the head cap can be performed on a non-ejection head in which non-ejection of ink is not eliminated by a wiping operation, among the recording heads.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
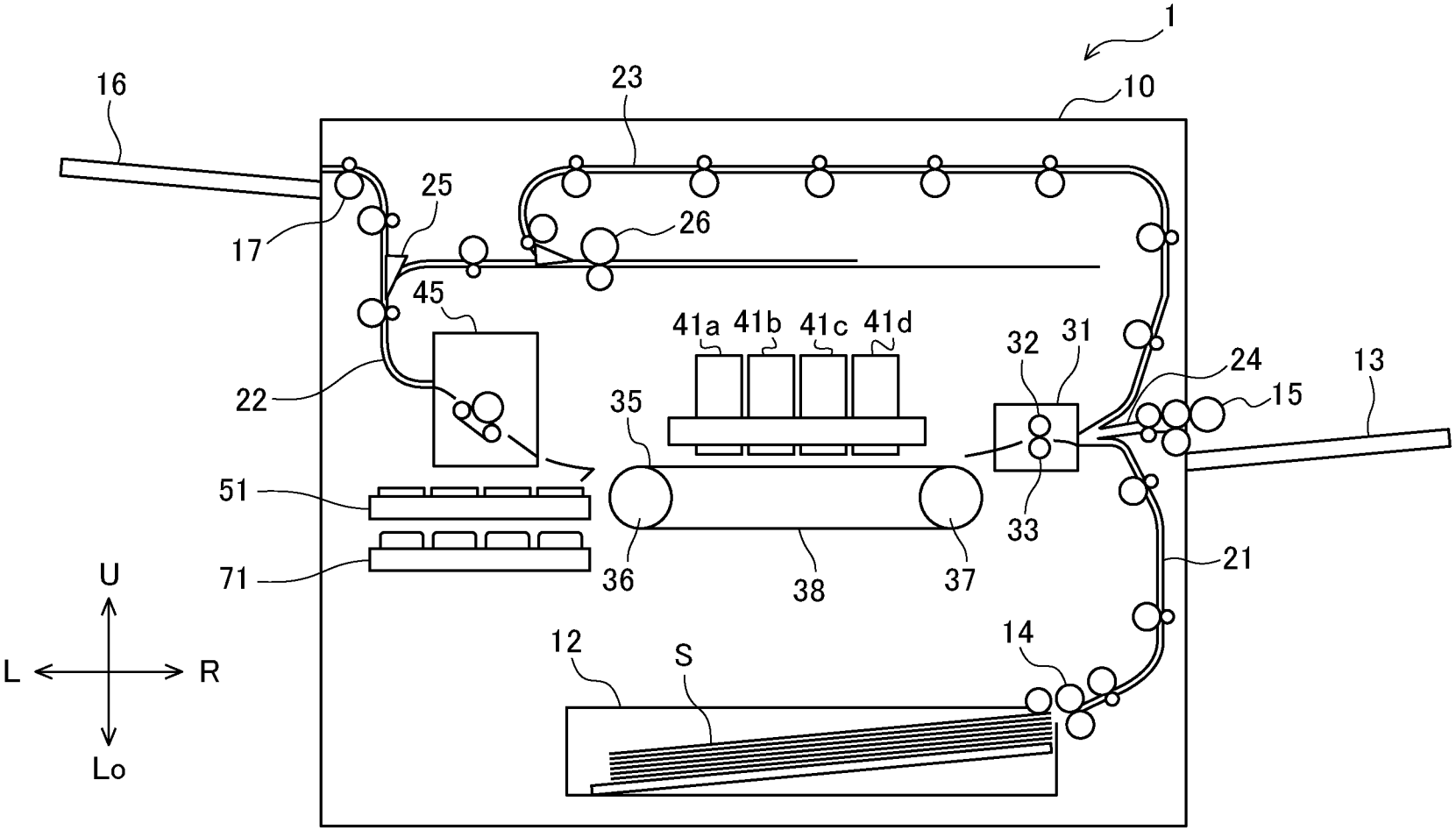
FIG. 1 is a view schematically showing an inkjet recording apparatus in the present embodiment.

Hereinafter, an inkjet recording apparatus 1 including a head cap according to the present embodiment will be described with reference to the drawings. FIG. 1 is a view schematically showing the inkjet recording apparatus 1 according to the present embodiment. For convenience of explanation, the front side of the paper surface on which FIG. 1 is drawn is defined as the front side of the inkjet recording apparatus 1, and the left-and-right directions is described with reference to a direction in which the inkjet recording apparatus 1 is viewed from the front side. Arrows L, R, U, Lo, Fr and Rr marked in each drawing indicate the left side, the right side, the upper side, the lower side, the front side, and the rear side of the inkjet recording apparatus 1, respectively.

As shown in FIG. 1, the inkjet recording apparatus 1 is configured to eject ink from inkjet type recording heads 41*a* to 41*d* toward a sheet S and to perform a one-side printing and a both-side printing on the sheet S. The inkjet recording apparatus 1 includes a box-shaped housing 10 in which various kinds of devices are housed. In the lower portion of the housing 10, a sheet feeding cassette 12 in which the sheet S is set is housed, and on the right side surface of the housing 10, a manual sheet feeding tray 13 in which the sheet S is set manually is installed. On the upper portion of the left side surface of the housing 10, a sheet discharge tray 16 on which the recorded sheet S is stacked is installed.

In the right side portion in the housing 10, a first conveyance path 21 along which the sheet S is conveyed from the sheet feeding cassette 12 toward the recording heads 41*a* to 41*d* provided in the center portion of the housing 10 is formed. On the upstream portion of the first conveyance path 21, a sheet feeding part 14 which feeds the sheet S from the sheet bundle set in the sheet feeding cassette 12 is provided. On the downstream portion of the first conveyance path 21, a registration roller device 31 which adjusts the feeding timing of the sheet S is provided. A sheet feeding path 24 extended from the manual sheet feeding tray 13 is communicated with the downstream end of the first conveyance path 21, and on the sheet feeding path 24 extended from the manual sheet feeding tray 13, a sheet feeding part 15 which feeds the sheet S from the sheet bundle on the manual sheet feeding tray 13 is provided.

The registration roller device 31 has a pair of registration rollers 32 and 33 facing each other in the upper-and-lower direction. The recording heads 41*a* to 41*d* and a conveyance unit 35 are provided on the downstream side of the registration roller device 31. The pair of registration rollers 32 and 33 correct the skew of the sheet S, and feed the sheet S to the conveyance unit 35 in accordance with the ink ejection operation by the recording heads 41*a* to 41*d*. The recording heads 41*a* to 41*d* eject inks of four colors of black, cyan, magenta and yellow, respectively. The conveyance unit 35 includes a conveyance belt 38 stretched between tension rollers 36 and 37 disposed below the recording heads 41*a* to 41*d*.

A decurl device 45 which corrects curl generated on the sheet S by drying the ink is provided downstream the conveyance unit 35. Below the decurl device 45, a cap unit 51 which caps the recording heads 41*a* to 41*d* and a wipe unit 71 which wipes the recording heads 41*a* to 41*d* are provided. On the downstream side of the decurl device 45, a second conveyance path 22 along which the sheet S is conveyed toward the sheet discharge tray 16 is formed. In the middle of the second conveyance path 22, a branch member 25 which switches the discharge destination of the sheet S is provided, and on the downstream portion of the second conveyance path 22, a sheet discharge part 17 which discharges the recorded sheet S to the sheet discharge tray 16 is provided.

In the upper portion in the housing 10, a third conveyance path 23 along which the sheet S is conveyed from the branch member 25 to the registration roller device 31 disposed in the downstream portion of the first conveyance path 21 is formed. In the middle of the third conveyance path 23, a sheet inversion part 26 which inverts the sheet S upside down is provided. When the sheet S is conveyed to the third conveyance path 23, the sheet S is switched back by the sheet inversion part 26, and the sheet S inverted upside down is conveyed toward the registration roller device 31. Thus, the sheet S is carried into the recording heads 41*a* to 41*d* from the registration rollers 32 and 33 with the back surface of the sheet S facing upward.

At the time of image recording, the sheet S is fed from the sheet feeding cassette 12 or the manual sheet feeding tray 13 by the sheet feeding parts 14 or 15, and is sent to the registration roller device 31. In accordance with the ink ejection timing, the sheet S is sent from the registration roller device 31 to the conveyance belt 38, and a color image is recorded on the front surface of the sheet S by the recording heads 41*a* to 41*d*. At the time of one-side recording, after the curl generated on the sheet S is corrected by the decurl device 45, the sheet S is conveyed along the second conveyance path 22 to the sheet discharge part 17, and the sheet S having the image recorded on the front surface is discharged to the sheet discharge tray 16 by the sheet discharge part 17.

At the time of both-side recording, after the curl generated in the sheet S is corrected by the decurl device 45, the sheet S having the image recorded on the front surface is inversed by the third conveyance path 23, and is conveyed again toward the registration roller device 31. Then, the sheet S is conveyed from the registration roller device 31 to the conveyance belt 38, and an image is recorded on the back surface of the sheet S by the recording heads 41*a* to 41*d*. Then, after the curl generated in the sheet S is corrected by the decurl device 45, the sheet S is conveyed to the sheet discharge part 17 along the second conveyance path 22, and the sheet S having images recorded on both sides is discharged to the sheet discharge tray 16 by the sheet discharge part 17.

When the recording heads 41*a* to 41*d* are cleaned, a purging operation is subjected to the recording heads 41*a* to 41, and a wiping operation is subjected to the wipe unit 71. The ink having high dispersion stability is used for the recording heads 41*a* to 41*d*. However, when the ink is dried, the dispersion stability is deteriorated, and aggregates of the ink (pigment) is produced in the recording heads 41*a* to 41*d*. The aggregates of the ink adhered to the nozzle hole or the nozzle surface can be removed by the purging operation and the wiping operation. However, it is not possible to sufficiently clean the portion deeper than the nozzle holes of the recording heads 41*a* to 41*d*, and it is difficult to remove the ink aggregates adhered to the inside of the recording heads 41*a* to 41*d*.

Therefore, the inkjet recording apparatus 1 according to the present embodiment is provided with the cap unit 51 which spreads a cleaning liquid to the inside of the recording heads 41*a* to 41*d*. The cleaning liquid is an example of a liquid in the present disclosure. The cap unit 51 includes head caps 53*a* to 53*d* (see FIG. 2) which cover the recording heads 41*a* to 41*d* such that the recording heads 41*a* to 41*d* are immersed in the cleaning liquid. Further, because the cleaning liquid in the head caps 53*a* to 53*d* is shaken due to vibration of the cap unit 51 and the others, the head caps 53*a* to 53*d* are provided with cap covers 58*a* to 58*d* (see FIG. 2) so as to prevent the cleaning liquid from being spilt.

Figure 2:
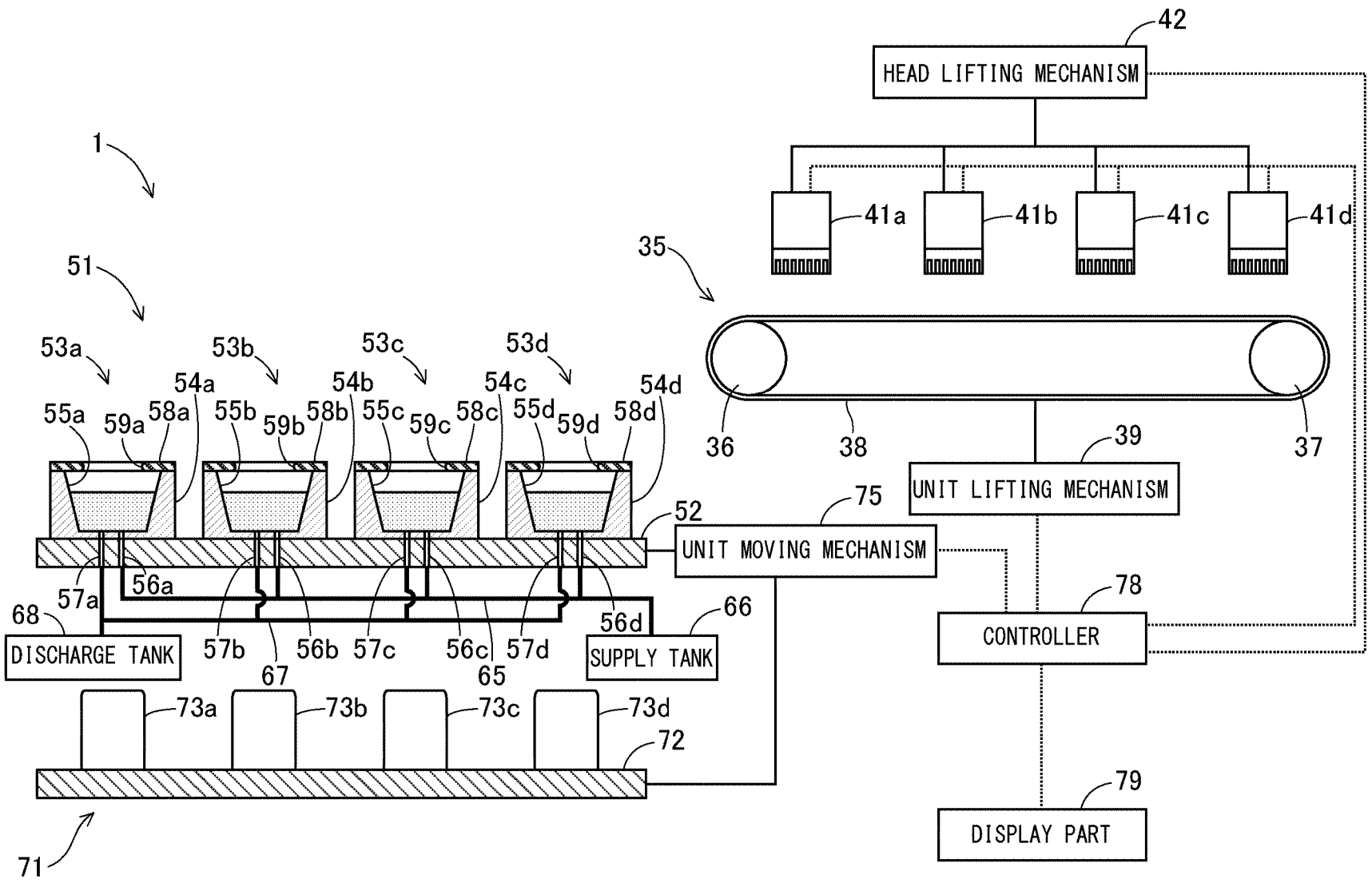
FIG. 2 is a view schematically showing a cap unit and a wipe unit in the present embodiment.
Figure 3:
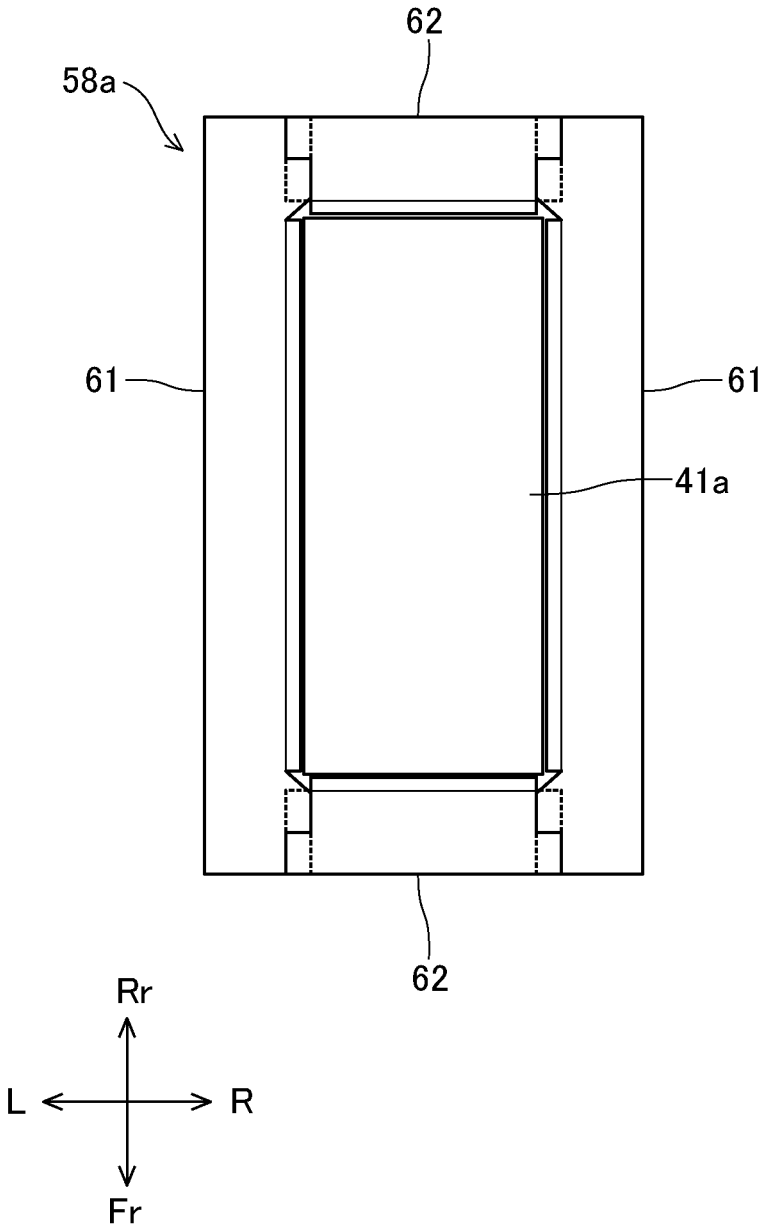
FIG. 3 is a top view schematically showing a head cap in the present embodiment.

With reference to FIG. 2 and FIG. 3, the cap unit 51 and the wipe unit 71 will be described. FIG. 2 is a view schematically showing the cap unit 51 and the wipe unit 71 according to the present embodiment. FIG. is a top view schematically showing the head cap according to the present embodiment.

As shown in FIG. 2, in the inkjet recording apparatus 1, the conveyance unit 35 is disposed below the recording heads 41*a* to 41*d*, and the cap unit 51 and the wipe unit 71 are disposed on the left side of the conveyance unit 35 so as to be aligned in the upper-and-lower direction. The conveyance unit 35 is connected to a unit lifting mechanism 39, and the conveyance unit 35 is lifted and lowered between a conveyance position and a standby position by the unit lifting mechanism 39. The cap unit 51 and the wipe unit 71 are connected to a unit moving mechanism 75, and the cap unit 51 and the wipe unit 71 are selectively moved in the left-and-right direction between a cleaning position and a standby position by the unit moving mechanism 75.

A large number of nozzle holes are formed in the nozzle surfaces of the recording heads 41*a* to 41*d*. Inside each of the recording heads 41*a* to 41*d*, a pressure chamber (not shown) communicated with to the nozzle hole and an internal flow path (not shown) communicated with to the pressure chamber are formed. A piezoelectric element (not shown) is provided in the pressure chamber. The pressure chamber is filled with the ink supplied from the ink tank, and when a driving voltage is applied to the piezoelectric element, the ink is ejected from the nozzle hole. A head lifting mechanism 42 is connected to the recording heads 41*a* to 41*d*, and the recording heads 41 to 41*d* are lifted and lowered by the head lifting mechanism 42 when the recording heads 41*a* to 41*d* are cleaned.

On a base plate 72 of the wipe unit 71, wiping blades 73*a* to 73*d* which wipe the nozzle surfaces of the recording heads 41*a* to 41*d* are provided. The wiping blades 73*a* to 73*d* are formed in a squeegee shape, and made of elastic material such as rubber. An advance and retreat mechanism (not shown) is connected to the wiping blades 73*a* to 73*d*, and the wiping blades 73*a* to 73*d* are moved in a wiping direction (a direction perpendicular to the paper surface) by the advance and retreat mechanism (not shown). The recording heads 41*a* to 41*d* have cleaning liquid applying portions (not shown), and the cleaning liquid is applied from the applying portions to the tips of the wiping blade 73*a* to 73*d*.

On a base plate 52 of the cap unit 51, head caps 53*a* to 53*d* which cover the recording heads 41*a* to 41*d* are provided. In the cap housing 54*a* to 54*d* of the head caps 53*a* to 53*d*, storage spaces 55*a* to 55*d* for the cleaning liquid are opened upward. The storage spaces 55*a* to 55*d* are formed in a trapezoidal shape in cross section such that its cross-sectional area narrows from the open end toward the bottom surface, and the cleaning liquid capable of dispersing the aggregates of the ink is stored in the storage spaces 55*a* to 55*d*. Compared with a case where the storage spaces 55*a* to

55*d* are formed in a rectangular shape in cross section, the usage amount of the cleaning liquid to the storage spaces 55*a* to 55*d* is suppressed.

Supply ports 56*a* to 56*d* and discharge ports 57*a* to 57*d* are formed on the cap housings 54*a* to 54*d* so as to penetrate through the base plate 52. To the supply ports 56*a* to 56*d*, a supply tank 66 is connected through supply passages 65. To the discharge ports 57*a* to 57*d*, a discharge tank 68 is connected through discharge passages 67. A pump (not shown) and a valve (not shown) are provided on the supply passage 65 and the discharge passage 67. The supply operation and the discharge operation of the cleaning liquid are performed by driving the pump and switching the valve, and the cleaning liquid contained in the storage spaces 55*a* to 55*d* is automatically replaced.

The open ends of the cap housings 54*a* to 54*d* are provided with rectangular frame-shaped cap covers 58*a* to 58*d* along the open ends. The cap covers 58*a* to 58*d* are made of elastic material such as rubber, and are attached to the open end of the cap housings 54*a* to 54*d*. The cap covers 58*a* to 58*d* have openings 59*a* to 59*d* through which the recording heads 41*a* to 41*d* can enter and leave. The recording heads 41*a* to 41*d* enters the storage spaces 55*a* to 55*d* through the openings 59*a* to 59*d* of the cap covers 58*a* to 58*d*, and the recording heads 41*a* to 41*d* are immersed in the cleaning liquid so that the cleaning liquid is spread to the inside of the recording heads 41*a* to 41*d*.

The opening shapes of the openings 59*a* to 59*d* of the cap covers 58*a* to 58*d* corresponds to the outer circumferential shapes of the recording heads 41*a* to 41*d*, and the circumferences of the recording heads 41*a* to 41*d* are covered with the cap covers 58*a* to 58*d*. Because only a small gap is formed between the opening edges of the cap covers 58*a* to 58*d* and the outer circumferential surfaces of the recording heads 41*a* to 41*d*, the opening edges of the cap covers 58*a* to 58*d* may come in contact with the outer circumferential surfaces of the recording heads 41*a* to 41*d*. Because the cap covers 58*a* to 58*d* are made of elastic material, the opening edges of the cap covers 58*a* to 58*d* are not lacked, but there is a possibility that the capping operation is performed while the cap covers 58*a* to 58*d* being deformed.

Therefore, the cross-sectional shape of the opening edges of the cap covers 58*a* to 58*d* are formed in a curved shape protruding inside the openings 59*a* to 59*d*. In the present embodiment, the cross-sectional shapes of the opening edges of the cap covers 58*a* to 58*d* are formed in a semicircular shape, and the apexes of the opening edges of the cap covers 58*a* to 58*d* are in point contact with the outer circumferential surfaces of the recording heads 41*a* to 41*d*. Thereby, contact areas between the opening edges of the cap covers 58*a* to 58*d* and the outer circumferential surfaces of the recording heads 41*a* to 41*d* are minimized, and the deformation of the cap covers 58*a* to 58*d* due to friction between the cap covers 58*a* to 58*d* and the recording heads 41*a* to 41*d* are suppressed. Further, even if the cleaning liquid is shaken, the cap covers 58*a* to 58*d* prevent the cleaning liquid from spilling from the storage spaces 55*a* to 55*d*.

As shown in FIG. 3, the cap cover 58*a* is formed of a pair of cover components 61 along the right and left side surfaces of the recording head 41*a* and a pair of cover components 62 along the front and rear side surfaces of the recording head 41*a*. A concave and convex shape is formed on the overlapped surfaces of the cover component 61 and the cover component 62, and the cover components 61 and 62 are overlapped with each other such that the concave and convex shapes of the cover component 61 and the cover component 62 are engaged with each other. For example, when the front surface side (the front side of the paper surface) of the overlapped surfaces of the cover component 61 and the cover component 62 are indicated by the solid line and the rear surface side (the back side of the paper surface) of the overlapped surfaces is indicated by the broken line, the concave and convex shapes of the cover component 61 and the cover component 62 are reversed on the front surface side and on the rear surface side of the overlapped surface. In the above manner, the pair of cover components 61 and 62 are engaged with each other.

Because the cover components 61, 62 are not integrated, transmission of the deformation of the cover components 61, 62 is suppressed as small as possible. For example, even if the opening edge of the cover component 61 hits the outer circumferential surface of the recording head 41*a* and a stress is generated, the stress is hardly transmitted from the cover component 61 to the cover component 62 on the overlapped surface of the cover components 61 and 62. In the above manner, a complex stress is hardly transmitted to the cap cover 58*a*, thereby improving the durability of the cap cover 58*a*. The cap covers 58*b* to 58*d* are formed of the cover components 61 and 62 similar to the cap cover 58*a*, and the durability of the cap covers 58*b* to 58*d* are is improved.

With reference to FIG. 2 again, the inkjet recording apparatus 1 is provided with a controller 78 which controls each part of the apparatus. The controller 78 controls the purging operation and the test pattern recording operation by the recording heads 41*a* to 41*d*, the wiping operation by the wipe unit 71, the capping operation by the cap unit 51, and the like. The controller 78 includes a logic circuit such as a field programmable gate array (FPGA), a processor such as a central processing unit (CPU), and a memory such as a read only memory (ROM) and a random access memory (RAM).

The controller 78 controls a normal cleaning procedure and a non-ejection head cleaning procedure. In the normal cleaning procedure, the purging operation, the wiping operation and the test pattern recording operation are performed. In the non-ejection head cleaning procedure, the capping operation, the purging operation, the wiping operation and the test pattern recording operation are performed for the non-ejection head. A display part 79 is connected to the controller 78 as a notification part. A message indicating the cleaning completion after the cleaning procedure for the non-ejection head is completed is displayed on the display part 79.

Figure 4:
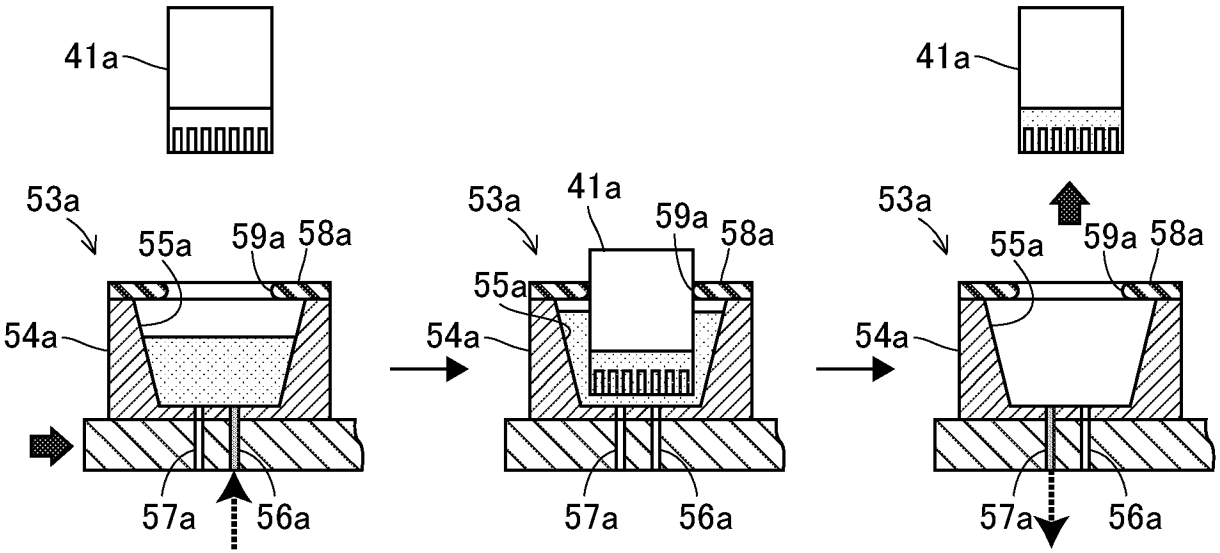
FIG. 4 is a view showing an example of a cleaning process of a non-ejection head in the present embodiment.
Figure 5:
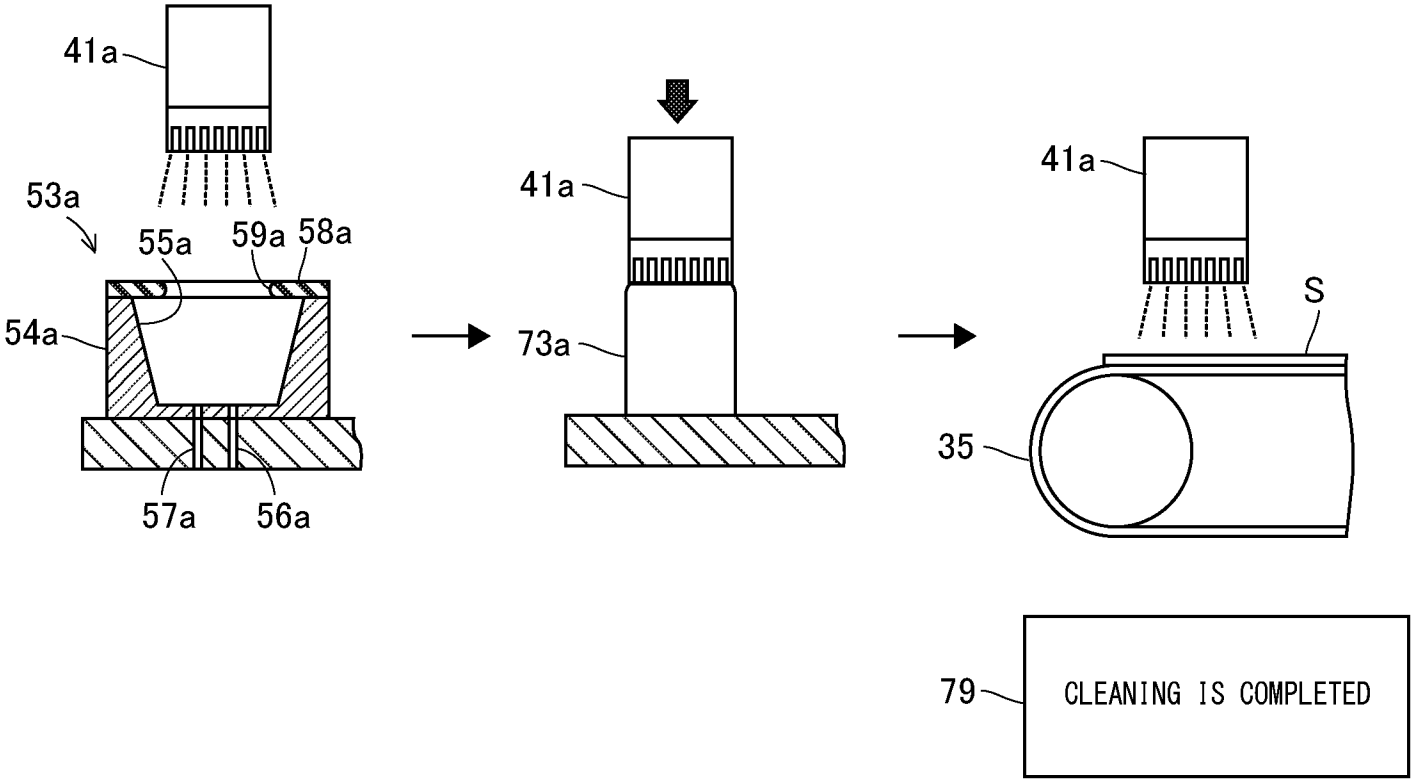
FIG. 5 is a view showing an example of a cleaning process of a non-ejection head in the present embodiment.

With reference to FIG. 4 and FIG. 5, the non-ejection head cleaning procedure will be described. FIG. 4 and FIG. 5 are views showing an example of the non-ejection head cleaning procedure according to the present embodiment.

As shown in the left view of FIG. 4, among the recording heads 41*a* to 41*d*, the recording head 41*a* whose ink ejection failure is not eliminated is selected as the non-ejection head. In this case, after the purging operation and the wiping operation are performed for the recording heads 41*a* to 41*d*, the non-ejection head is selected based on the recording result of the test pattern for the recording heads 41*a* to 41*d*. When the recording head 41*a* is selected as the non-ejection head, the head cap 53*a* is positioned below the recording head 41*a*. The cleaning liquid is supplied from the supply port 56*a* to the storage space 55*a* of the head cap 53*a*, and a sufficient amount of the cleaning liquid for immersing the recording head 41*a* is stored in the storage space 55*a*.

As shown in the center view of FIG. 4, the head cap 53*a* covers the recording head 41*a*. The recording head 41*a* is immersed in the cleaning liquid in the storage space 55*a* through the opening 59*a* of the cap cover 58*a*. At this time, the friction between the opening edge of the cap cover 58*a* and the outer circumferential surface of the recording head 41*a* is minimized, and the deformation of the cap cover 58*a* is suppressed. The cleaning liquid enters through the nozzle holes of the recording head 41*a* and spreads the inside of the recording head 41*a*. A state where the head cap 53*a* covers the recording head 41*a* is kept for a predetermined period, and then the aggregates of the ink adhered to the inside is dispersed by the cleaning liquid.

As shown in the right view of FIG. 4, the head cap 53*a* is separated from the recording head 41*a*, and the cleaning liquid is discharged from the storage space 55*a* of the head cap 53*a* through the discharge port 57*a*. In such a capping operation, the head cap 53*a* vibrates during the operation, causing a shake of the liquid level of the cleaning liquid in the storage space 55*a*. Although the cleaning liquid rises toward the wall surfaces of the storage space 55*a* due to the shake of the liquid level, since the cap cover 58*a* is provided on the upper ends of the wall surfaces of the storage space 55*a* in the shape of an eaves, the cleaning liquid is prevented from spilling from the storage space 55*a* by the cap cover 58*a*.

As shown in the left view of FIG. 5, after the recording head 41*a* is separated from the head cap 53*a*, the purging operation is performed again by the recording head 41*a*. The cleaning liquid remaining inside the recording head 41*a* or in the nozzle is discharged by the purging operation. As shown in the center view of FIG. 5, the wiping blade 73*a* is positioned below the recording head 41*a*, and the wiping operation is performed again for the nozzle surface of the recording head 41*a* by the wiping blade 73*a*. Foreign matter remaining on the nozzle surface of the recording head 41*a* is scraped off by the wiping operation. The capping operation, the purging operation and the wiping operation eliminate the non-ejection failure of ink of the recording head 41*a*.

Then, as shown in the right view in FIG. 5, after the wiping operation for the nozzle surface of the recording head 41*a* is completed, the conveyance unit 35 is positioned below the recording head 41*a*. Then, a massage indicating the completion of cleaning is displayed on the display part 79 and the test pattern recording operation is performed by the recording head 41*a*. The user is informed of the return of the recording head 41*a* by the message indicating the completion of cleaning, and reconfirms whether the non-ejection of ink of the recording head 41*a* is eliminated based on the recording result of the test pattern. When the non-ejection of the recording head 41*a* is not eliminated, the above cleaning procedure may be repeated or the replacement work of the recording head 41*a* may be performed.

As described above, according to the present embodiment, when the recording heads 41*a* to 41*d* are covered with the cap housings 54*a* to 54*d*, the recording heads 41*a* to 41*d* enter the storage spaces 55*a* to 55*d* of the cleaning liquid through the openings 59*a* to 59*d* of the cap covers 58*a* to 58*d*. By immersing the recording heads 41*a* to 41*d* in the cleaning liquid, the cleaning liquid is spread to the insides of the recording heads 41*a* to 41*d* to disperse the aggregates of ink. Thus, the non-ejection of ink is eliminated without replacing the recording heads 41*a* to 41*d*. Further, even if the cleaning liquid is shaken, the cap covers 58*a* to 58*d* prevent the cleaning liquid from spilling from the storage spaces 55*a* to 55*d*.

Figure 6:
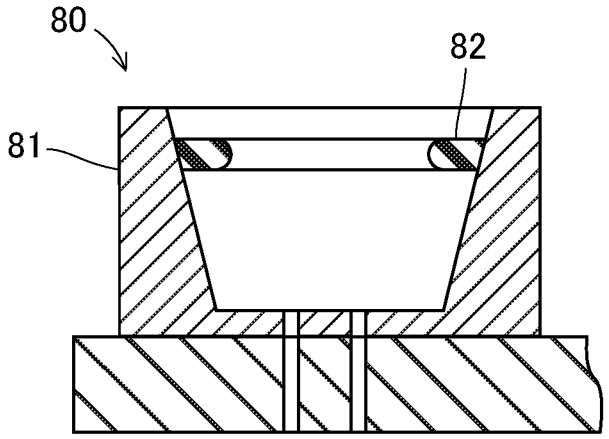
FIG. 6 is a view showing a head cap in one modified example.

In the present embodiment, although the cap cover is provided at the open end of the cap housing, the cap cover may be provided along the open end of the cap housing. For example, as the head cap 80 shown in FIG. 6, if the cap cover 82 is provided along the open end of the cap housing 81, the cap cover 82 may be provided on the inner circumferential surface of the cap housing 81.

Figure 7:
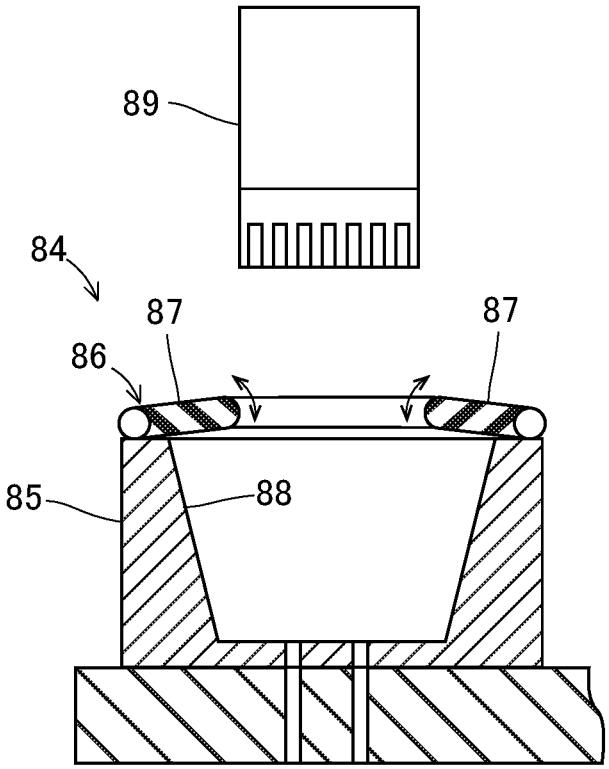
FIG. 7 is a view schematically showing a head cap in another modified example.

Further, in the present embodiment, although each cover component of the cap cover is attached to the cap housing in a non-turnable manner, as the head cap 84 shown in FIG. 7, each cover component 87 of the cap cover 86 may be attached to the cap housing 85 in a turnable manner. By turning each cover component 87, the entering and leaving of the recording head 89 into and out of the storage space 88 of the cap housing 85 is guided.

In the present embodiment, although the cap cover is formed of a plurality of cover components, the cap cover may be formed of one component.

Further, in the present embodiment, although the cross-sectional shape of the opening edge of the cap cover is formed into a curved surface shape, the cross-sectional shape of the opening edge of the cap cover is not particularly limited. For example, if the friction between the opening edge of the cap cover and the outer circumferential surface of the recording head is sufficiently reduced, the cross-sectional shape of the opening edge of the cap cover may be formed into a flat shape.

Further, in the present embodiment, although the storage space is formed in a trapezoidal shape in cross section in which the cross-sectional area narrows from the open end toward the bottom surface, the cross-sectional shape of the storage space is not particularly limited as long as the cleaning liquid can be contained to such a degree that the cleaning liquid can be spread to the inside of the recording head.

Further, in the present embodiment, although the display part is shown as an example of a notification part, the notification part may be a lamp or a speaker capable of notifying the completion of the cleaning after the wiping operation of the nozzle surface of the non-ejection head. That is, the completion of the cleaning may be announced with light by the lamp, or the completion of the cleaning may be announced with voice by the speaker.

Further, in the present embodiment, although a sheet-like recording medium is shown as a recording medium, a belt-like recording medium may be used. Alternatively, a plastic film, a recording paper, a cloth or the like may be used as the recording medium.

Although the present embodiment has been described, as another embodiment, the above-described embodiment and the modification may be wholly or partially combined.

The technology disclosed in the present invention is not limited to the above embodiments, and may be changed, replaced, or modified in various ways without departing from the spirit of the technical concept. Further, if the technical idea can be realized in another way by the progress of the technology or another technique derived from the technology, the method may be used. Accordingly, the claims cover all embodiments that may be included within the scope of the technical idea.

The invention claimed is:

1. A head cap covering an inkjet type recording head, the head cap comprising:

a cap housing having a liquid storage space opened upward, in which liquid in which the recording head is immersed is stored; and a cap cover provided along an open end of the cap housing, having an opening through which the recording head enters and leaves, and covering a circumference of the recording head, wherein a cross sectional shape of an open edge of the opening of the cap cover is formed in a curved surface shape protruding inside the opening, and an apex of the open edge of the opening of the cap cover is in point contact with an outer circumferential surface of the recording head.

2. The head cap according to claim 1, wherein a shape of the opening corresponds to an outer circumferential shape of the recording head, and when the recording head enters the cap cover, an outer circumference of the recording head is covered with the cap cover.

3. The head cap according to claim 1, wherein the cap cover is made of elastic material.

4. The head cap according to claim 1, the storage space is formed such that a cross sectional area narrows from an open end toward a bottom surface.

5. The head cap according to claim 1, wherein the recording head has a rectangular cross section, and the cap cover is formed of a plurality of cover components along each side surface of the recording head.

6. The head cap according to claim 5, wherein the cover components are provided on an open end of the cap housing in a turnable manner.

7. An inkjet recording apparatus comprising:

the head cap according to claim 1; and a wiping blade wiping a nozzle surface of the recording head, wherein a capping operation for covering the head cap can be performed on a non-ejection head in which non-ejection of ink is not eliminated by a wiping operation, among the recording heads.

8. The inkjet recording apparatus according to claim 7, wherein after the non-ejection head is separated from the head cap, the non-ejection head is applied with a purging operation, and the nozzle surface of the non-ejection head is applied with a wiping operation by the wiping blade.

9. The inkjet recording apparatus according to claim 8, further comprising a notification part which notifies a completion of the cleaning after the wiping operation for the nozzle surface of the non-ejection head is performed.

10. The inkjet recording apparatus according to claim 8, wherein after the wiping operation for the nozzle surface of the non-ejection head is performed, a test pattern is recorded by the non-ejection head.

* * * * *